US005409190A

United States Patent [19]

Mattox

[11] Patent Number: 5,409,190

[45] Date of Patent: Apr. 25, 1995

[54] BEVERAGE CUP HOLDER WITH SAFETY LATCH

[76] Inventor: Robert T. Mattox, 2629 Del Vista Dr., Hacienda Heights, Calif. 91745

[21] Appl. No.: 169,598

[22] Filed: Dec. 16, 1993

[51] Int. Cl.[6] ..... A47F 7/00

[52] U.S. Cl. ..... 248/315; 248/206.5

[58] Field of Search ..... 248/206.5, 311.2, 312.1, 248/314, 315, 683, 689, 231.7

[56] References Cited

U.S. PATENT DOCUMENTS

| | | | |
|---|---|---|---|
| D. 208,617 | 9/1967 | Heselov et al. . | |
| 1,355,750 | 10/1920 | Leibner . | |
| 1,393,673 | 10/1921 | Dingee . | |
| 3,055,381 | 9/1962 | Zielinski . | |
| 3,314,635 | 4/1967 | Frye . | |
| 3,482,910 | 12/1969 | Debelius . | |
| 3,945,596 | 3/1976 | Marraccini | 248/246 X |
| 4,100,684 | 7/1978 | Berger | 211/50 X |
| 4,222,541 | 9/1980 | Cillis | 248/311.2 X |
| 4,783,037 | 1/1989 | Flowerday | 248/311.2 |
| 4,795,211 | 1/1989 | Stern et al. | 297/194 |
| 4,828,211 | 5/1989 | McConnell et al. | 248/311.2 |
| 5,054,726 | 10/1991 | Mattox | 248/206.5 |

FOREIGN PATENT DOCUMENTS

| | | |
|---|---|---|
| 1421505 | 11/1965 | France . |
| 1078946 | 7/1958 | Germany . |

*Primary Examiner*—Ramon O. Ramirez
*Attorney, Agent, or Firm*—Poms, Smith, Lande & Rose

[57] ABSTRACT

An apparatus for securely holding a full-sized beverage cup to a metallic leg of a chair has an angle support and magnets. The magnets are permanently affixed to interior walls of the angle support. The apparatus is removably mounted onto the metallic chair leg with the magnets placed in contact with surfaces of the chair leg. A ring attaches to an exterior wall of the angle support and extends from the exterior wall. An "L"-shaped locking member is rotatably mounted in a sleeve attached to the angle support. A wing nut fixedly attaches to a threaded shaft portion of the "L"-shaped locking member so that the locking member will rotate when a user turns the wing nut.

12 Claims, 2 Drawing Sheets

BEVERAGE CUP HOLDER WITH SAFETY LATCH

FIELD OF THE INVENTION

The present invention generally relates to an apparatus for holding full-sized beverage cups, and more specifically to such a beverage cup holder having a safety latch that keeps the cup holder securely attached to a chair leg.

BACKGROUND OF THE INVENTION

It is common in business and civic life for sizable groups of people to attend meetings, seminars, and conferences. Such groups often convene in large multipurpose rooms, such as halls, hotels, or convention centers. Mass seating is typically provided with foldable or stackable chairs having metallic legs.

Many people attending such events become thirsty at some point, and attendees are likely to bring cups of coffee, juice, or other drinks to their seats. Unfortunately, there is rarely a convenient place to place a full beverage cup, and an attendee faces a problem when she must put her cup down in order to take notes or to peruse reading material. One option is to put the cup on the floor, but too often the cup gets kicked over and at least some of the liquid spills out, potentially creating a mess and perhaps making the floor dangerously slippery. Another option is to put the cup down on an empty seat. But empty seats are rarely available and, anyhow, a cup sitting on a seat is still vulnerable to tipping over. Needless to say, spilled drinks and the stains, mess, hazards and clean-up problems that they present have become a bane of business and civic meetings.

U.S. Pat. No. 5,054,726 (the "'726 Patent"), issued to the present inventor on Oct. 8, 1991, discloses an apparatus to enable the average metal-legged, foldable or stackable chair to hold a lightweight communion cup at religious services. The apparatus includes an angle support provided with a pair of magnetic blocks to attach the apparatus to a metal chair leg. A holding ring is attached to the angle support, and serves to support the communion cup in an upright position.

While the invention that the '726 Patent discloses has proven highly successful for communion cups, a potential problem could arise if the invention were to be adapted for holding standard-sized drink cups. Specifically, a standard-sized cup filled with liquid is considerably heavier than a communion cup, and small or weak magnets could have trouble holding the apparatus to the chair leg when a passer-by bumps into the chair or the apparatus. The apparatus could disengage from the chair leg, thereby allowing the drink cup to tumble to the floor. Thus, even the invention of the '726 Patent with all of its many advantages may not fully address the drink-holding needs of business and civic meetings.

SUMMARY OF THE INVENTION

It is therefore a primary object of the present invention to provide a drink holder for full-sized beverage cups that will attach to a metallic member of a portable or foldable chair. The drink holder should include a safety latch to prevent the drink holder from disengaging from the metallic member when a person bumps into the chair or into the drink holder.

Generally stated, the present invention has an angle support provided with magnetic blocks. A horizontal drink-holding ring is tangentially attached to an exterior wall of the angle support. The apparatus is removably mounted onto a metallic member of the chair by placing each of the magnetic blocks into contact with the metallic member. A locking member is rotatably mounted to the angle support. A user can rotate the locking member into a locked position which prevents the apparatus from detaching from the metal leg when someone bumps the chair and/or the apparatus.

Other objects, features, and advantages of the invention will become apparent to those skilled in the art from a consideration of the following detailed description and the accompanying drawings.

DETAILED DESCRIPTION OF THE PREFERRED EMBODIMENTS

Figure 1:
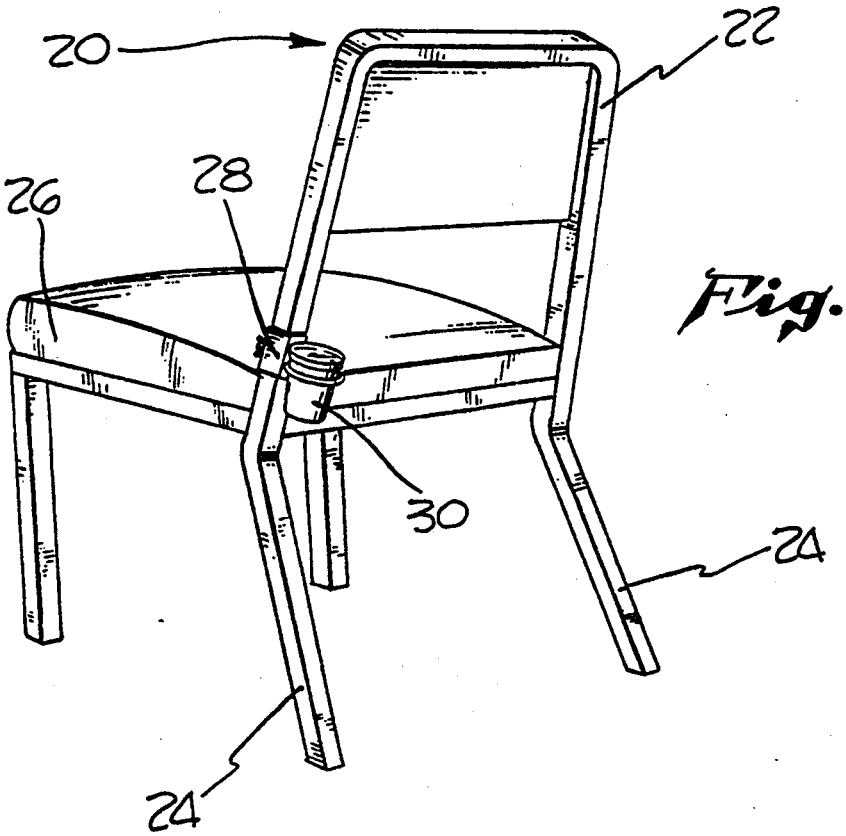
FIG. 1 is a perspective view of a beverage cup holder mounted onto a metallic member of a portable chair.

FIG. 1 shows a portable chair 20 having a metallic frame 22 and seat cushion 26. A beverage cup holder 28 is magnetically mounted onto metallic frame 22 and holds beverage cup 30. It should be noted that the particular location of beverage cup holder 28 is not critical, and that it could alternatively be attached to metallic frame 22 at legs 24 or onto any metallic member of the chair.

Figure 2:
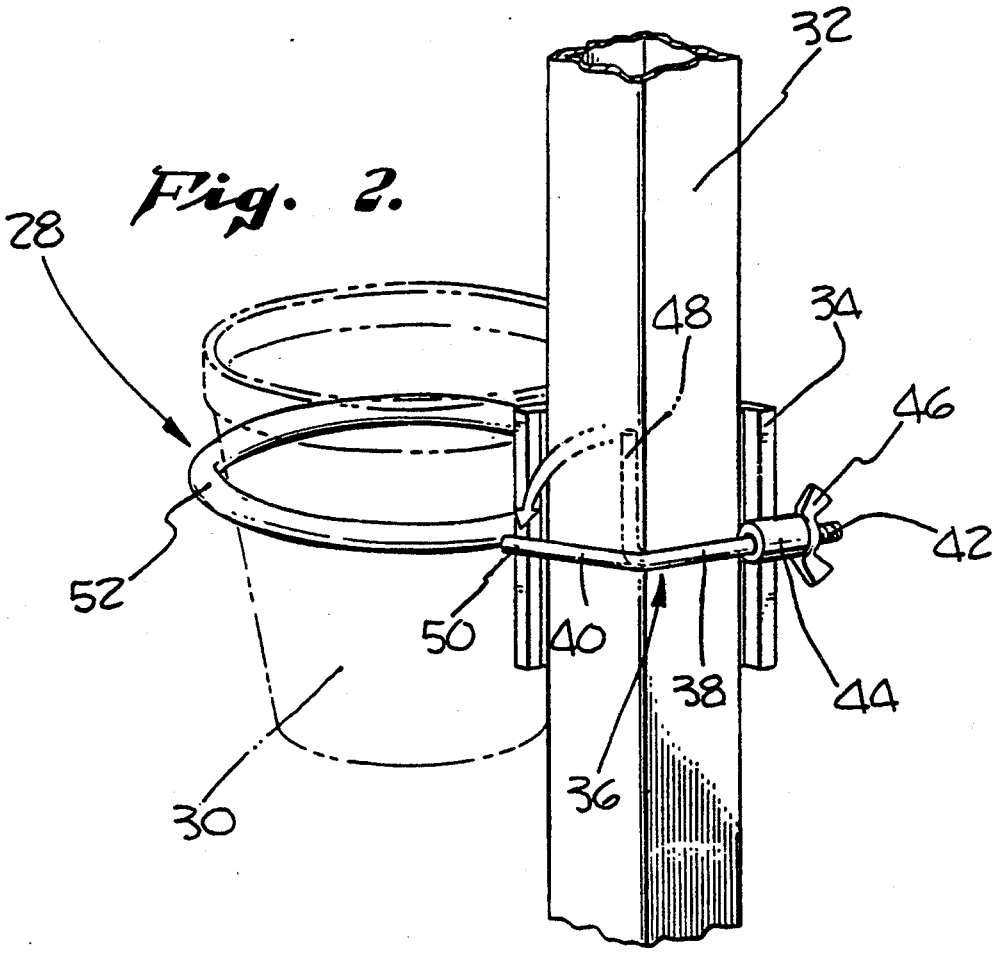
FIG. 2 is a detail perspective view of the beverage cup holder of FIG. 1 showing the safety latch in locked and unlocked positions.
Figure 3:
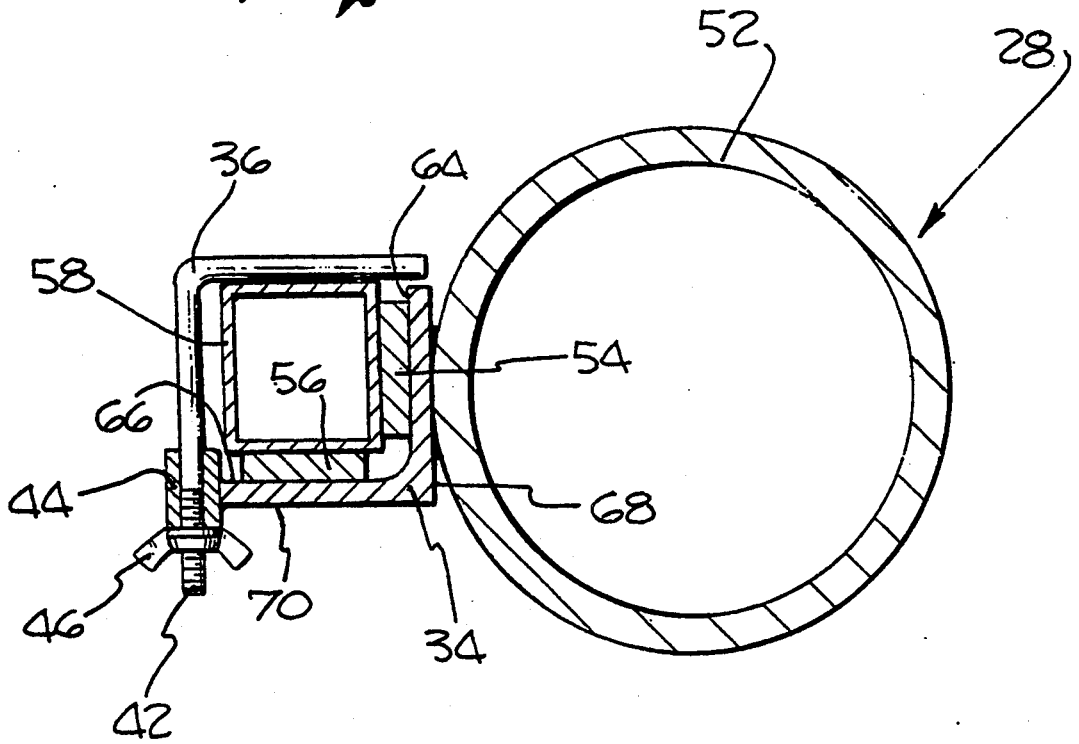
FIG. 3 is a sectional view showing the beverage cup holder of FIG. 1 mounted onto a chair member having a square cross-section.

FIG. 2 shows beverage cup holder 28 in more detail. Beverage cup holder 28 includes an angle support 34 which attaches to metallic post 32. FIG. 3 shows that angle support 34 has first and second interior walls 64 and 66, onto which are mounted magnetic block members 54 and 56, respectively. The magnets may be mounted with nuts and bolts, glue, or any of a variety of common mounting methods. Angle support 34 also has first and second exterior walls 68 and 70. A beverage cup support ring 52 is attached to the angle support along first exterior wall 68. The ring may have sufficient diameter to retain a full-sized beverage cup holding 8 ounces of liquid or more.

Returning to FIG. 2, sleeve 44 is attached to an edge of angle support 34. Sleeve 44 rotatably supports a lock having an "L"-shaped locking member 36, which includes a first arm 38 and a second arm 40. First arm 38 has a threaded end portion 42 which protrudes from an end of sleeve 44. A wing nut 46 is permanently attached to the threads of threaded end portion 42. The manufacturer determines the position of wing nut 46 on threaded end portion 42 based upon how long first arm 38 should be for a particular size and geometry of chair leg. Commercial stud and bearing mount adhesives such as LOCTITE and similar well-known products may be used to bond wing nut 46 onto threaded end portion 42.

The "L"-shaped locking member rotates from an unlocked position 48 to a locked position 50. To rotate the locking member, a user grasps and turns the prongs of wing nut 46. The "L"-shaped locking member necessarily turns with the wing nut. Alternatively, the user may simply grasp second arm 40 and directly move it into the locked position. Sleeve 44 may be provided with a rubber bushing along the interior at 62 (FIG. 4) to provide rotational friction with first arm 38. Such friction prevents gravity from rotating the "L"-shaped locking member when not desired.

In unlocked position 48, the user may put angle support 34 into engagement with metallic post 32 without interference from locking member 36. However, once angle support 34 is suitably engaged on post 32, the user may rotate the locking member into locked position 50. In this position, the drink cup holder 28 will not disengage from post 32 when someone bumps into the chair or into the drink holder.

Figure 4:
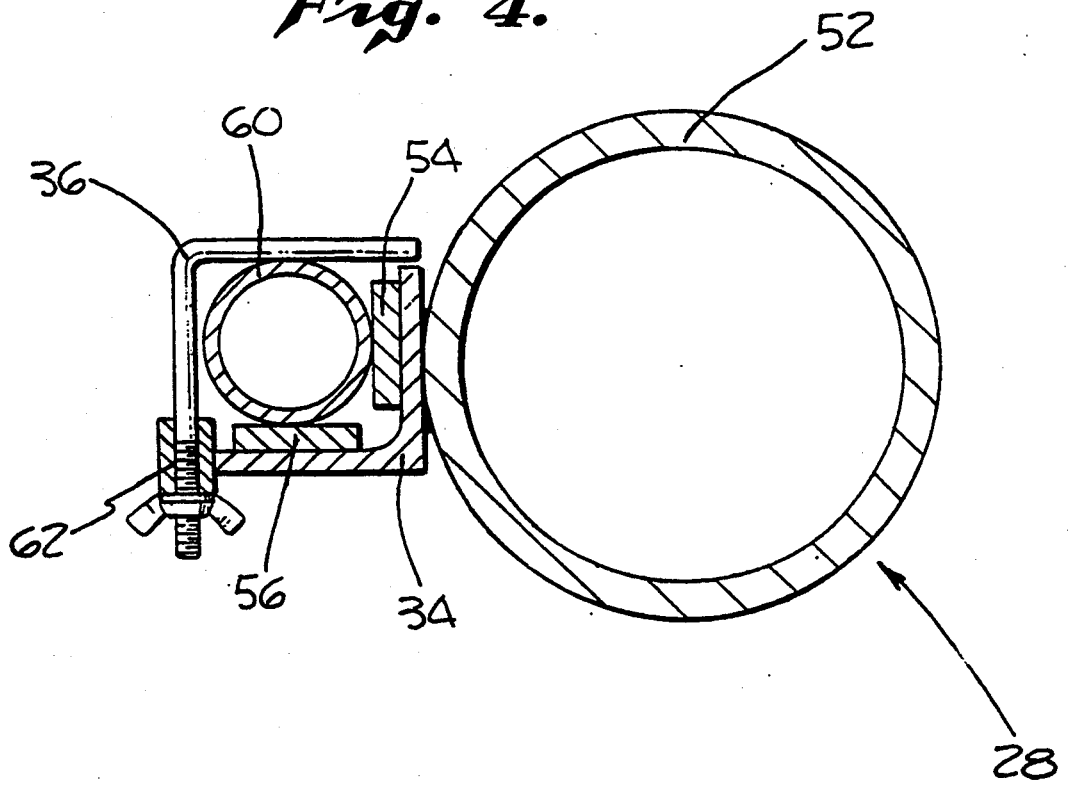
FIG. 4 is a sectional view showing the beverage cup holder of FIG. 1 mounted onto a chair member having a circular cross-section.

FIG. 3 shows that the drink cup holder will easily attach to a post having a square or rectangular cross-section 58. Similarly, FIG. 4 shows that the drink cup holder will just as easily attach to a post having a circular cross-section 60. Consequently, the present invention may be used with a variety of different chair types having differently shaped frame members.

As for materials, the present drink cup holder may be made of a metal, such as steel. Sleeve 44 and drink support ring 52 can then be welded to angle support 34. However, a metallic sleeve is preferably lined with a bushing or lining 62 to provide friction between the "L"-shaped locking member and the sleeve. As previously discussed, the bushing prevents gravity from rotating the "L"-shaped locking member beyond locked position 50, which would disengage the lock.

Alternately, cup holder 28 may be molded plastic. Sleeve 44 and ring 52 are then integral with angle support 34. When "L"-shaped locking member 36 is also made of plastic, there is natural friction between the "L"-shaped locking member and the sleeve. Consequently, no friction bushing 62 is necessary to prevent gravity from pulling the locking member out of locked position 50.

An embodiment of the present invention may have the following dimensions. Drink cup holding ring 52 may have an inside diameter of $2\frac{5}{8}''$ and an outside diameter of $3\frac{1}{8}''$. The ring member may have a width of $\frac{1}{4}''$. The first exterior wall 68 and second exterior wall 70 of angle support 34 may be $1\frac{1}{4}''$ wide and $\frac{1}{8}''$ thick. First and second magnetic blocks 54 and 56 may be $\frac{3}{4}''$ wide and 3/16" thick. Sleeve 44 may have an outer diameter of 5/16" and may be $\frac{3}{8}''$ long. First and second arms 38 and 40 of "L"-shaped locking member 36 may have a circular cross-section with a diameter of $\frac{1}{8}''$. Additionally, second arm 40 may be $1\frac{1}{8}''$ long, while first arm 38 may be $1\frac{3}{4}''$ long.

While a particular preferred embodiment has been disclosed, it will be understood that variations and modifications may be effected without departing from the spirit and scope of the invention. Thus, by way of example and not of limitation, locking member 36 may have shapes other than an "L" in order to adapt to chairs having members with irregular cross-sections. The portion of first arm 38 which is in contact with the interior surface of sleeve 44 may have a greater diameter than the rest of first arm 38. The surface area of contact between the interior of sleeve 44 and first arm 38 is thereby increased, providing additional frictional force to hold locking member 36 in position after the user has rotated the locking member into locked position 50. First arm 38 may also have an adjustable length to fit a variety of different sizes and shapes of chair legs. A stop may be provided on an edge of angle support 34 to prevent "L"-shaped locking member 36 from rotating downward beyond a locked position. The angle between exterior walls 68 and 70 of angle support 34 need not be 90° as shown in the drawings, but may be any other angle. Angle support 34 may even have a curved profile to match the shape of a curved chair member. Additionally, first arm 38 may be provided with integral arms, thereby eliminating the need for wing nut 46.

Accordingly, the present invention is not limited to the specific embodiment shown in the drawings and described in the detailed description.

What is claimed is:

1. An apparatus for securely holding a beverage cup to a metallic leg of a chair, the apparatus comprising:

an angle support having a first and second interior wall, and a first and second exterior wall;

a first and second magnetic block, each of said blocks being permanently affixed to a respective one of said interior walls;

a ring attached to said first exterior wall such that said ring extends from said first exterior wall; and a substantially "L"-shaped locking member having a first locking member arm and a second locking member arm, said locking member being rotatably mounted to said angle support;

wherein said angle support further comprises a sleeve, at least a portion of said first locking member arm being rotatably mounted in said sleeve;

said first locking member arm includes a threaded shaft portion and a wing nut fixedly attached to said threaded shaft portion so that said locking member will rotate when a user rotates said wing nut; and the apparatus is removably mounted onto said metallic chair leg with said magnetic blocks placed in contact with surfaces of said metallic chair leg.

2. An apparatus for securely holding a beverage cup to a metallic member of a chair comprising:

an angle support having interior walls and exterior walls;

magnets, each of said magnets being permanently affixed to a respective one of said interior walls;

a ring attached to an exterior wall such that said ring extends from said exterior wall; and a locking member that is rotatably mounted to said angle support;

wherein the apparatus is removably mounted onto said metal member by placing said magnets in contact with surfaces of said metallic chair member;

the locking member max be rotated into a position which prevents the apparatus from detaching from the metallic chair member when someone bumps the chair and/or the apparatus; and said locking member is a substantially "L"-shaped member having a first locking member arm and a second locking member arm.

3. An apparatus as defined in claim 2, wherein said angle support further comprises a sleeve, at least a portion of said first locking member arm being rotatably mounted in said sleeve.

4. An apparatus as defined in claim 3, wherein said sleeve is made of metal and has a bushing to provide friction to prevent said first locking member arm from freely rotating unless a user manually rotates said first locking member arm or said second locking member arm.

5. An apparatus as defined in claim 3, wherein said sleeve and said angle support are plastic, and said sleeve is an integrally molded portion of said angle support.

6. An apparatus as defined in claim 3, wherein said first locking member arm includes a threaded shaft portion, and wherein a wing-nut is fixedly attached to said threaded shaft portion so that said locking member will rotate when a user rotates said wing-nut.

7. An apparatus for holding a cup, said apparatus being attachable to a metallic member of a chair and comprising:

an angle support having a first and second interior wall and a first and second exterior wall;

a first and second magnet, said first magnet being permanently affixed to said first interior wall and said second magnet being permanently affixed to said second interior wall;

a ring for holding a cup, said ring being attached to said first exterior wall such that said ring extends from said first exterior wall; and a lock for preventing the apparatus from detaching from the metallic chair member when someone bumps either the chair or the apparatus;

wherein said lock includes a rotatable, substantially "L"-shaped locking member.

8. An apparatus as defined in claim 7, wherein said apparatus further comprises a sleeve on an edge of said angle support, said sleeve rotatably supporting said "L"-shaped locking member.

9. An apparatus as defined in claim 8, wherein:

said "L"-shaped locking member has a first arm and a second arm;

said sleeve rotatably supports said first arm; and said first arm has protrusions which a user can grasp to rotate said second arm into a locked position, thereby preventing the apparatus from detaching from the metallic chair member.

10. An apparatus as defined in claim 9, wherein said protrusions comprise a wing nut fixedly attached to a threaded portion of said first arm.

11. An apparatus as defined in claim 8, wherein said angle clip, said ring, and said sleeve are composed of metal, and said sleeve includes a lining to provide friction between said sleeve and said "L"-shaped locking member.

12. An apparatus as defined in claim 8, wherein said angle clip, said ring, and said sleeve are composed of molded plastic, and said angle clip, said ring and said sleeve constitute an integrally-molded component.

* * * * *